US005641077A

United States Patent [19]

Tufano et al.

[11] Patent Number: 5,641,077

[45] Date of Patent: Jun. 24, 1997

[54] BIASING DEVICE FOR HOOK-SUSPENDED MERCHANDISE

[75] Inventors: Thomas F. Tufano, Fair Lawn; Steven W. Mann, Tenafly, both of N.J.

[73] Assignee: Goodren Products Corp., Englewood, N.J.

[21] Appl. No.: 540,498

[22] Filed: Oct. 10, 1995

[51] Int. Cl.[6] ..... A47F 7/00

[52] U.S. Cl. ..... 211/54.1

[58] Field of Search ..... 211/54.1, 59.2, 211/51, 59.1, 57.1, 59.3; 248/220.4, 220.3, 221.1

[56] References Cited

U.S. PATENT DOCUMENTS 3,251,464 5/1966 Hanson .
3,696,937 10/1972 Braverman .
4,062,137 12/1977 Herzog .
4,066,169 1/1978 Hochman .
4,475,658 10/1984 Roberts .
4,821,894 4/1989 Dechirot .
4,869,376 9/1989 Valiulis .
5,009,334 4/1991 Bodkins .
5,054,646 10/1991 Hammerschlang et al. .
5,114,021 5/1992 Fredrickson .
5,222,608 6/1993 Eklof et al. .

*Primary Examiner*—Alvin C. Chin-Shue
*Assistant Examiner*—Sarah L. Purol
*Attorney, Agent, or Firm*—Arthur Jacob

[57] ABSTRACT

A biasing device for use in a pegboard merchandise display in which items of merchandise are suspended along a hook of the display includes a strip of resilient synthetic polymeric material forming a bow between the pegboard and the items of merchandise suspended along the hook, mounting tabs captured between the pegboard and the hook to secure the strip in place, and a pusher pad for pushing against the rearwardmost suspended item to maintain the forwardmost suspended item at a dispensing location at the forward end of the hook.

15 Claims, 3 Drawing Sheets

BIASING DEVICE FOR HOOK-SUSPENDED MERCHANDISE

The present invention relates generally to the display and dispensing of merchandise at a point of purchase and pertains, more specifically, to a biasing device utilized in connection with a plurality of items of merchandise suspended along a hook in a pegboard display to place the items in a desired forward dispensing location for presentation to a prospective purchaser.

It has become commonplace for retailers to display smaller items of merchandise for sale by suspending the items on hooks mounted upon pegboard. Such pegboard displays have been found to be more effective when the items of merchandise suspended on each pegboard display hook are biased toward the front of the hook where the forwardmost item becomes more prominent and therefore better presented for sale. Thus, various devices have been proposed for pushing the items forward on the hook, as the items are dispensed, so as to present the forwardmost item at a desired forward dispensing location.

Among the various devices offered for use in connection with pegboard displays, a simple biasing member in the form of a strip of resilient material, bowed so as to bias the items of merchandise forward, has been suggested as an economical and versatile device. The present invention provides an improvement in such a biasing device and, as such, attains several objects and advantages, some of which are summarized as follows: Provides a simple, economical biasing device for use in connection with a pegboard display for smooth and reliable operation in the dispensing of items of merchandise offered for sale; enables simplicity of installation and use, even after assembly of the hook with the pegboard in a pegboard display; allows versatility in accommodating a variety of pegboard display configurations; is adapted readily for use with items of merchandise of various dimensions and weight; provides an attractive as well as functional vehicle for displaying merchandise-related indicia, such as identification logos and the like, as well as advertising copy and inventory status information; provides dependable operation over an extended service life, while maintaining low cost and high quality.

The above objects and advantages, as well as further objects and advantages, are attained by the present invention which may be described briefly as a biasing device for use in a merchandise display in which a plurality of items of merchandise are suspended from an elongate hook and are biased for movement longitudinally along the hook from a rearward end of the hook toward a forward end of the hook for dispensing the items serially at a dispensing location at the forward end of the hook, the hook being mounted upon an upright display board and having an elongate rod with a longitudinal axis extending along a length between the rearward end and the forward end of the hook, the hook including a mounting bracket at the rearward end, the mounting bracket having a downwardly-depending leg for resting against the display board and a pair of arms, the arms being located below the axis of the rod and extending laterally in opposite directions from the axis of the rod, each arm carrying a finger for extending through the display board at locations spaced laterally and downwardly from the axis of the rod and having an upwardly-directed finger portion for retaining the hook upon the display board, the hook further including a merchandise retainer at the dispensing location for retaining, at the dispensing location, the forwardmost item of the plurality of items of merchandise suspended on the hook, the biasing device comprising: an elongate strip of resilient synthetic polymeric material extending longitudinally between a rearward end and a forward end, the strip having a longitudinal length, a lateral width and an altitudinal thickness, the longitudinal length being greater than the length of the rod and having an intermediate port]on, and the lateral width being much greater than the altitudinal thickness of the strip; at least one mounting tab at the rearward end of the strip, the mounting tab including an outer perimeter, and a first lateral score line between the mounting tab and the intermediate portion of the strip for enabling the mounting tab to be folded to extend altitudinally downwardly from the intermediate portion for juxtaposition with a corresponding arm of the mounting bracket of the hook; an opening in the mounting tab for receiving the corresponding arm through the mounting tab to capture the mounting tab between the arm and the display board; a pusher pad at the forward end of the strip, and a second lateral score line between the pusher pad and the intermediate portion of the strip for enabling the pusher pad to be folded to extend altitudinally downwardly from the intermediate portion for juxtaposition with the rearwardmost item of merchandise suspended on the hook; a first aperture adjacent the rearward end of the strip for receiving the rod through the strip at a rearward end of the intermediate portion; and second and third apertures establishing a bridge adjacent the forward end of the strip for receiving the rod through the strip and beneath the bridge at a forward end of the intermediate portion with the strip in sliding engagement with the rod and the pusher pad located below the axis of the rod; the first, second and third apertures establishing a bow in the intermediate portion of the strip, between the mounting tab and the bridge and beneath the axis of the rod, the bow being resiliently contractible to accommodate the plurality of items of merchandise suspended on the rod between the pusher pad and the merchandise retainer and resiliently expandable to bias the items of merchandise toward the forward end of the hook and place the forwardmost item at the dispensing location.

The invention will be understood more fully, while still further objects and advantages will become apparent, in the following detailed description of a preferred embodiment of the invention illustrated in the accompanying drawing, in which.

Figure 4:
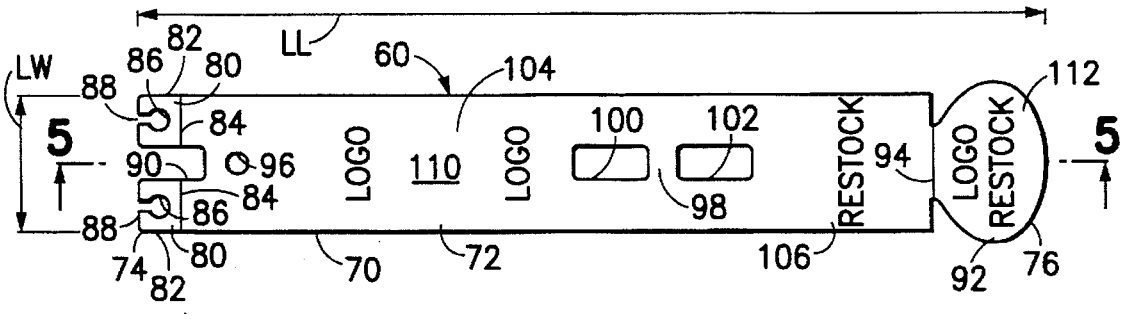
FIG.4 is a top plan view of a blank from which the biasing device is to be erected.
Figure 5:
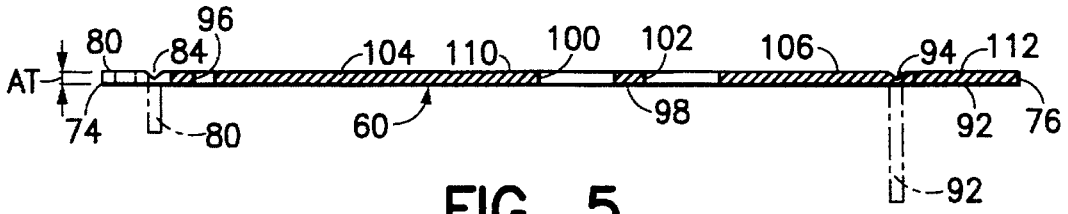
Figure 6:
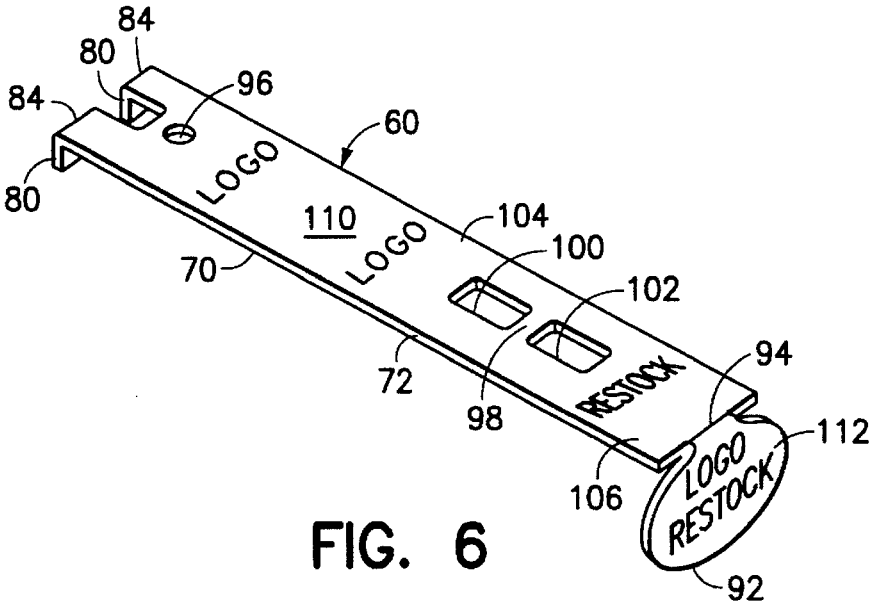

FIG 5 a cross-sectional view of the blank of FIG. 4, taken along line 5—5 of FIG. 4, with the erect configuration shown in phantom; and FIG. 6 is a perspective view of the biasing device, erected and ready for installation.

Figure 1:
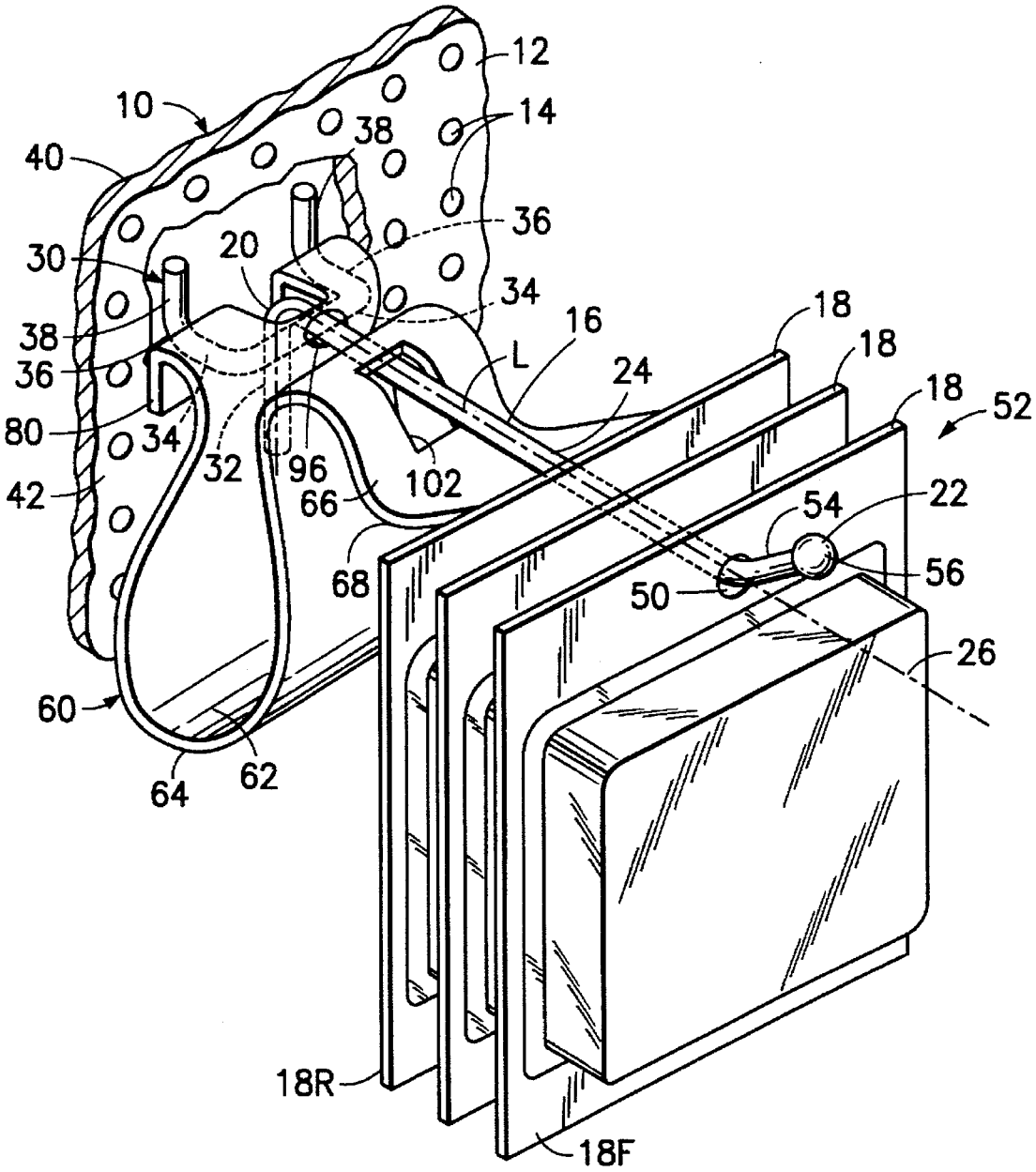
FIG. 1 is a pictorial perspective view of a biasing device constructed in accordance with the invention and installed in a point of purchase pegboard display.

Referring now to the drawing, and especially to FIG. 1 thereof, a fragment of a pegboard display is illustrated at 10 and is seen to include an upright display board in the form of a pegboard 12 having a matrix of holes 14 for the reception of a number of pegboard hooks, one of which hooks is shown at 16, for the assembly of a point of purchase display at which a plurality of items of merchandise are presented for sale, with the items 18 suspended from a hook 16, as illustrated. Pegboard 12 is oriented generally vertically, and hook 16 is mounted upon the pegboard 12 so as to extend generally horizontally, from a rearward end 20 adjacent the pegboard 12 to a forward end 22 remote from the pegboard 12. Hook 16 has an elongate rod 24 with a longitudinal axis 26 extending along a length L between the rearward end 20 and the forward end 22 of the hook 16. A mounting bracket 30 at the rearward end 20 of the hook 16 has a downwardly-depending leg 32 and a pair of laterally extending arms 34 located below the axis 26 and carrying fingers 36 spaced apart in opposite lateral directions from the axis 26 for extending through corresponding holes 14, each finger 36 having upwardly-extending finger portions 38 for engaging the rear face 40 of the pegboard 12 while the leg 32 engages the front face 42 of the pegboard 12 to retain the hook 16 upon the pegboard 12.

The items 18 are suspended along the hook 16 by virtue of the rod 24 passing through suspension openings 50 in the items 18, in a now conventional manner. A dispensing location 52 is located at the forward end 22 of the hook 16 and includes a merchandise retainer shown in the form of an upturned portion 54 adjacent the forward end 22 of the hook 16 and a terminal stop 56 integral with the forward end 22 of the hook 16. In the preferred arrangement, the forwardmost item 18F is placed at the dispensing location 52 so that a prospective purchaser may view the item 18F and selectively remove the item 18F from the hook 16 merely by pulling the item 18F along the upturned portion 54 and over the terminal stop 56. Accordingly, items 18 are biased forward and move along the rod 24 in a forward direction in response to the removal of each item 18F so as to assure that the next consecutive item 18 is placed in the forwardmost position, at the dispensing location 52, regardless of how many items 18 remain suspended on the hook 16, for accomplishing serial dispensing of the items 18 at the dispensing location 52.

Figure 2:
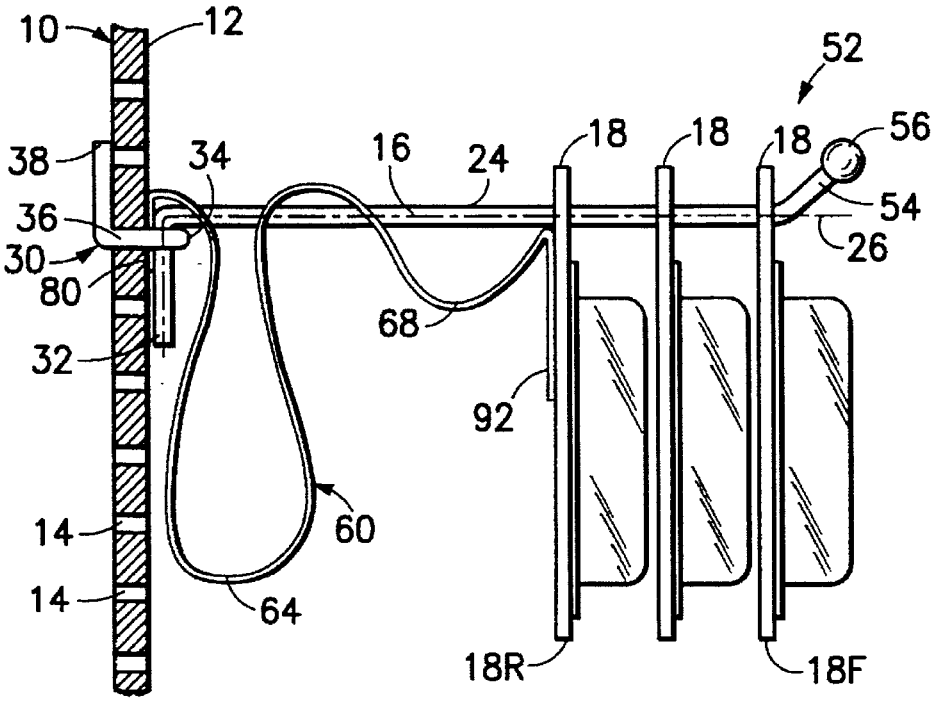
FIG. 2 is a side elevational view of the installation of FIG. 1, with the display in one state of operation.
Figure 3:
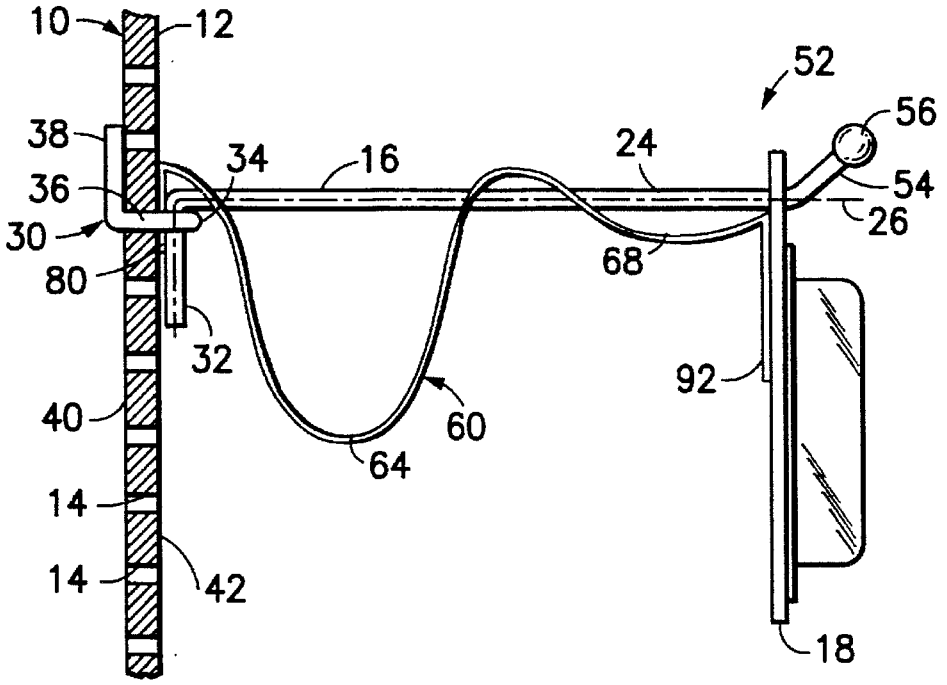
FIG. 3 is a side elevational view similar to FIG. 2, but with the display shown in another state of operation.

In order to bias the items forward, as described, a biasing device 60, constructed in accordance with the present invention, is assembled with the hook 16 and placed between the pegboard 12 and the rearwardmost item 18R. Biasing device 60 is constructed of a resilient synthetic polymeric material and includes a first elongate portion 62 which when assembled with the hook 16 forms a resilient first bow 64 arranged to bias the plurality of items 18 in the forward direction. A second elongate portion 66 of the biasing device 60 forms a second resilient bow 68, also arranged to bias the plurality of items 18 in the forward direction. As best seen in FIGS. 2 and 3, as well as in FIG. 1, when the display 10 is fully loaded with merchandise, a plurality of items 18 are suspended from the rod 24 of the hook 16, between the dispensing location 52 and the pegboard 12. The first bow 64 and the second bow 68 of the biasing device 60 are compressed and the resilient nature of material of the biasing device 60 enables such compression while biasing the items 18 forward, to place the forwardmost item 18F at the dispensing location 52, with the item 18F retained in place by the upturned portion 54, as seen in FIG. 2. As the items 18 are dispensed from the dispensing location 52, the resilient nature of the material of the biasing device 60 enables the bows 64 and 68 to expand so that the biasing device 60 continues to bias the forwardmost item 18F into the dispensing location 52 for display and dispensing.

Turning now to FIGS. 4 and 5, biasing device 60 is constructed from a blank 70 shown in the form of an elongate strip 72 extending longitudinally between a rearward end 74 and a forward end 76. The strip 72 has a longitudinal length LL, a lateral width LW and an altitudinal thickness AT, the longitudinal length LL being greater than the length L of the rod 24, and the lateral width LW being much greater than the altitudinal thickness AT. A pair of mounting tabs 80 are located at the rearward end 74, each mounting tab 80 having an outer perimeter 82 including a lateral score line 84 in the strip 72. An opening 86 passes through each mounting tab 80 and a slit 88 in each mounting tab 80 extends from the opening 86 to the outer perimeter 82. A notch 90 is interposed laterally between the mounting tabs 80 and extends longitudinally forward beyond the score lines 84, all for purposes set forth in detail below.

A pusher pad 92 is placed at the forward end 76 of the strip 72 and a lateral score line 94 is located between the pusher pad 92 and the remainder of the strip 72. A first aperture 96 is located adjacent the rearward end 74 of strip 72 and a bridge 98 is established between second and third apertures 100 and 102, respectively, the bridge 98 establishing the forward boundary and the score lines 84 establishing the rearward boundary of a first intermediate portion 104 of the strip 72. A second intermediate portion 106 of the strip 72 is established between the bridge 98 and the lateral score line 94.

Strip 72 preferably is opaque and includes an upper surface 110 upon which merchandise-related indicia is imprinted for display. Thus, the upper surface 110 provides a convenient and practical vehicle for a product identification logo as well as for advertising copy related to the merchandise suspended on the hook 16. Should the items 18 along a particular hook 16 be exhausted, the face 112 of the pusher pad 92 will be exposed, thereby providing a convenient location for inventory information advising of the particular item 18 which must be replaced.

When the biasing device 60 is erected for use, the mounting tabs 80 are folded downwardly, along score lines 84, as seen in phantom in FIG. 5, and the pusher pad 92 likewise is folded downwardly, along score line 94, as illustrated in phantom, to establish the fully erected biasing device 60 illustrated in FIG. 6. The biasing device 60 then is installed on the hook 16 and secured in place by threading the rod 24 through the first aperture 96, with the first intermediate portion 104 placed beneath the rod 24, and then threading the rod 24 through the second and third apertures 100 and 102, with the bridge 98 extending laterally over the rod 24 and the second intermediate portion 106 placed beneath the rod 24 so that the first intermediate portion 104 establishes the first bow 64 beneath the rod 24 and between the mounting bracket 30 and the bridge 98, and the second intermediate portion 106 establishes the second bow 68 between the bridge 98 and the pusher pad 92. The second and third apertures 100 and 102 are elongated somewhat along the longitudinal direction to facilitate sliding engagement with rod 24, for sliding movement of the forward end 76 of the strip 72 in response to the biasing forces exerted by the bows 64 and 68 as the suspended items 18 are moved forward by the biasing device 60. The pusher pad 92 is located beneath the axis 26 and abuts the rearwardmost item 18R for pushing the items 18 forward.

The fingers 36 of the mounting bracket 30 are passed through the openings 86 in the mounting tabs 80 and the notch 90 enables the mounting tabs 80 to straddle the depending leg 32 of the mounting bracket 30 so that upon mounting the hook 16 upon the pegboard 12, the mounting tabs 80 are captured between the arms 34 of the mounting bracket 30 and the pegboard 12, as, seen in FIGS. 1 through 3, to secure the biasing device 60 in place on the hook 16. The slits 88 in the mounting tabs 80 enable the installation to be accomplished when the mounting bracket 30 is already engaged with the pegboard 12 so that the above-described installation of the biasing device 60 can be accomplished either before or after the hook 16 is mounted on the pegboard 12, rendering the biasing device 60 more versatile in that biasing devices 60 readily are installed and secured in existing pegboard displays without requiring dismantling of the display.

The preferred synthetic polymeric material is polyvinyl chloride, which material possesses the desired resilience coupled with the ability to bear imprinted indicia on the upper face 110 of the strip 72, for purposes explained above. A typical biasing device 60 has a length LL of about 10.5 inches and width LW of about 1.5 inches. The altitudinal thickness AT is chosen to provide the desired biasing force for the particular item 18 being displayed. Thus, larger and heavier items 18 will require a greater thickness AT while smaller and lighter items 18 need less biasing force and can be biased appropriately by a strip 72 of lesser thickness AT. Typically, the thickness AT is chosen within a range of about 0.010 to about 0.015 inch.

It will be seen that the present invention attains the several objects and advantages summarized above, namely: Provides a simple, economical biasing device for use in connection with a pegboard display for smooth and reliable operation in the dispensing of items of merchandise offered for sale; enables simplicity of installation and use, even after assembly of the hook with the pegboard in a pegboard display; allows versatility in accommodating a variety of pegboard display configurations; is adapted readily for use with items of merchandise of various dimensions and weight; provides an attractive as well as functional vehicle for displaying merchandise-related indicia, such as identification logos and the like, as well as advertising copy and inventory status information; provides dependable operation over an extended service life, while maintaining low cost and high quality.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A biasing device for use in a merchandise display in which a plurality of items of merchandise are suspended from an elongate hook and are biased for movement longitudinally along the hook from a rearward end of the hook toward a forward end of the hook for dispensing the items serially at a dispensing location at the forward end of the hook, the hook being mounted upon an upright display board and having an elongate rod with a longitudinal axis extending along a length between the rearward end and the forward end of the hook, the hook including a mounting bracket at the rearward end, the mounting bracket having a downwardly-depending leg for resting against the display board and a pair of arms, the arms being located below the axis of the rod and extending laterally in opposite directions from the axis of the rod, each arm carrying a finger for extending through the display board at locations spaced laterally and downwardly from the axis of the rod and having an upwardly-directed finger portion for retaining the hook upon the display board, the hook further including a merchandise retainer at the dispensing location for retaining, at the dispensing location, the forwardmost item of the plurality of items of merchandise suspended on the hook, the biasing device comprising:

an elongate strip of resilient synthetic polymeric material extending longitudinally between a rearward end and a forward end, the strip having a longitudinal length, a lateral width and an altitudinal thickness, the longitudinal length being greater than the length of the rod and having an intermediate portion, and the lateral width being much greater than the altitudinal thickness of the strip;

at least one mounting tab at the rearward end of the strip, the mounting tab including an outer perimeter, and a first lateral score line between the mounting tab and the intermediate portion of the strip for enabling the mounting tab to be folded to extend altitudinally downwardly from the intermediate portion for juxtaposition with a corresponding arm of the mounting bracket of the hook;

an opening in the mounting tab for receiving the corresponding arm through the mounting tab to capture the mounting tab between the arm and the display board;

a pusher pad at the forward end of the strip, and a second lateral score line between the pusher pad and the intermediate portion of the strip for enabling the pusher pad to be folded to extend altitudinally downwardly from the intermediate portion for juxtaposition with the rearwardmost item of merchandise suspended on the hook;

a first aperture adjacent the rearward end of the strip for receiving the rod through the strip at a rearward end of the intermediate portion; and second and third apertures establishing a bridge adjacent the forward end of the strip for receiving the rod through the strip and beneath the bridge at a forward end of the intermediate portion with the strip in sliding engagement with the rod and the pusher pad located below the axis of the rod;

the first, second and third apertures establishing a bow in the intermediate portion of the strip, between the mounting tab and the bridge and beneath the axis of the rod, the bow being resiliently contractible to accommodate the plurality of items of merchandise suspended on the rod between the pusher pad and the merchandise retainer and resiliently expandable to bias the items of merchandise toward the forward end of the hook and place the forwardmost item at the dispensing location.

2. The invention of claim 1 including a slit in the mounting tab from the opening in the mounting tab to the outer perimeter of the mounting tab for enabling placement of the finger in the opening while the mounting bracket is engaged with the display board.

3. The invention of claim 1 wherein the second and third apertures are elongated in the longitudinal direction for facilitating sliding movement of the forward end of the intermediate portion of the strip along the rod.

4. The invention of claim 1 including two mounting tabs spaced laterally from one another in opposite directions from the axis of the rod for engaging each mounting tab with a corresponding arm of the bracket, and a first lateral score line between each mounting tab and the intermediate portion of the strip.

5. The invention of claim 4 wherein the second and third apertures are elongated in the longitudinal direction for facilitating sliding movement of the forward end of the intermediate portion of the strip along the rod.

6. The invention of claim 4 including a notch between the mounting tabs for straddling the leg of the bracket when the mounting tabs are captured between the display board and the arms of the bracket.

7. The invention of claim 6 wherein the notch extends longitudinally forward beyond the first lateral score lines.

8. The invention of claim 6 including a slit in each mounting tab from the opening in the mounting tab to the outer perimeter of the mounting tab for enabling placement of each finger in the corresponding opening while the mounting bracket is engaged with the display board.

9. The invention of claim 1 wherein the synthetic polymeric material is polyvinyl chloride.

10. The invention of claim 9 wherein the thickness of the strip is in the range of about 0.010 to about 0.015 inch.

11. The invention of claim 9 wherein the synthetic polymeric material includes an opaque upper face bearing merchandise-related indicia thereon.

12. The invention of claim 1 wherein the strip includes a further intermediate portion between the bridge and the second lateral score line for establishing a further bow in the strip between the bridge and the pusher pad and beneath the axis of the rod, the further bow being resiliently contractible to further accommodate the plurality of items of merchandise suspended on the rod between the pusher pad and the merchandise retainer and resiliently expandable to further bias the items of merchandise toward the forward end of the hook and place the forwardmost item at the dispensing location.

13. The invention of claim 12 wherein the second and third apertures are elongated in the longitudinal direction for facilitating sliding movement of the bridge along the rod.

14. The invention of claim 13 including two mounting tabs spaced laterally from one another in opposite directions from the axis of the rod for engaging each mounting tab with a corresponding arm of the bracket, and a first lateral score line between each mounting tab and the intermediate portion of the strip.

15. The invention of claim 14 including a notch between the mounting tabs for straddling the leg of the bracket when the mounting tabs are captured between the display board and the arms of the bracket.

* * * * *